US010352643B2

(12) United States Patent
Battaglia et al.

(10) Patent No.: US 10,352,643 B2
(45) Date of Patent: Jul. 16, 2019

(54) QUAD LOCK MULTICALIBER RIFLE RECEIVER WITH LOCKING BARREL

(71) Applicant: Vincent P. Battaglia, Easton, CT (US)

(72) Inventors: Vincent P. Battaglia, Easton, CT (US); Philip Battaglia, Easton, CT (US)

(73) Assignee: Vincent P. Battaglia, Easton, CT (US)

( * ) Notice: Subject to any disclaimer, the term of this patent is extended or adjusted under 35 U.S.C. 154(b) by 9 days.

(21) Appl. No.: 15/711,115

(22) Filed: Sep. 21, 2017

(65) Prior Publication Data

US 2018/0080733 A1 Mar. 22, 2018

Related U.S. Application Data

(60) Provisional application No. 62/397,613, filed on Sep. 21, 2016.

(51) Int. Cl.

| | |
|---|---|
| ***F41A 21/48*** | (2006.01) |
| ***F41A 21/10*** | (2006.01) |
| ***F41A 11/02*** | (2006.01) |
| *F41A 21/12* | (2006.01) |

(52) U.S. Cl.

CPC ..... *F41A 21/484* (2013.01); *F41A 11/02* (2013.01); *F41A 21/10* (2013.01); *F41A 21/482* (2013.01); *F41A 21/12* (2013.01)

(58) Field of Classification Search

CPC ..... F41A 21/48; F41A 21/481; F41A 21/482; F41A 21/484; F41A 21/485; F41A 21/487; F41A 21/488

USPC ..... 42/75.02

See application file for complete search history.

(56) References Cited

U.S. PATENT DOCUMENTS

| | | | | |
|---|---|---|---|---|
| 3,731,418 | A * | 5/1973 | Birkenhagen | F41A 21/481 42/75.02 |
| 5,540,008 | A * | 7/1996 | Kirnstatter | F41A 21/484 42/75.02 |
| 8,087,194 | B1 * | 1/2012 | Vuksanovich | F41A 21/48 42/75.01 |
| 8,782,943 | B2 | 7/2014 | Jarboe | |
| 9,151,553 | B2 | 10/2015 | Constant et al. | |
| 9,163,889 | B2 | 10/2015 | Constant et al. | |
| 9,234,717 | B2 | 1/2016 | Jarboe | |
| 2005/0188584 | A1 * | 9/2005 | Orth | F41A 11/04 42/71.01 |

(Continued)

*Primary Examiner* — Joshua E Freeman

(74) *Attorney, Agent, or Firm* — DeLio Peterson & Curcio LLC; Peter W. Peterson

(57) ABSTRACT

A rifle comprises a quad lock multicaliber receiver, a barrel extension, a bolt, and a projection engageable with the receiver. The barrel extension includes a cartridge chamber and is securable in an end of the receiver. The bolt is slideable in the receiver and engages a cartridge in the cartridge chamber during the firing phase. The projection comprises locking bars extending through the receiver, and is moveable between locked and unlocked positions to allow for securing and removing of the barrel extension, respectively. Positioning bars are disposed on either side of the receiver split parallel to its longitudinal axis. The locking bars are disposed between these positioning bars and the barrel extension such that when the positioning bars are urged toward each other the receiver split is closed and the positioning bars urge the locking bars toward and into locking grooves to secure the barrel extension in the receiver.

10 Claims, 5 Drawing Sheets

(56) References Cited

U.S. PATENT DOCUMENTS

| | | | | |
|---|---|---|---|---|
| 2005/0188591 | A1* | 9/2005 | Stone | F41A 21/485<br>42/75.02 |
| 2010/0059032 | A1* | 3/2010 | Zadra | F41A 11/02<br>124/63 |
| 2012/0073179 | A1* | 3/2012 | Young | F41A 21/485<br>42/75.02 |
| 2013/0219765 | A1* | 8/2013 | Ibarguren | F41A 21/485<br>42/75.02 |
| 2015/0007478 | A1* | 1/2015 | Barrett | F41A 21/481<br>42/75.02 |
| 2016/0010938 | A1* | 1/2016 | Merkley | F41A 21/482<br>42/75.02 |

* cited by examiner

QUAD LOCK MULTICALIBER RIFLE RECEIVER WITH LOCKING BARREL

This application claims priority to U.S. Provisional Patent Application No. 62/397,613, filed on Sep. 21, 2016.

BACKGROUND OF THE INVENTION

1. Field of the Invention

This invention relates in general to a rifle receiver, and more specifically to a modular, precision bolt action rifle receiver with a locking mechanism for the barrel to enable highly accurate marksmanship.

2. Description of Related Art

Typical receivers provide housing for the hammer, bolt, and firing mechanism, and may be threaded to receive a barrel. The receiver is often made of forged steel or aluminum. These receivers vary in terms of accuracy and compatibility, and must be machined to conform with particular rifle models. The bolts are typically made of two pieces—the face and the body. The face piece of the bolt is interchangeable with different sized faces in conformity with different caliber cartridges. This two-piece design thus sacrifices accuracy during firing and also increases costs. Barrels and barrel extensions that are threaded into the forward end of the receiver make exchange difficult.

Constant military requirements urge the advancement of the precision bolt action rifle to further refinements for accuracy and modularity. A modular receiver that does not sacrifice accuracy has therefore become desirable in the market place.

SUMMARY OF THE INVENTION

Bearing in mind the problems and deficiencies of the prior art, it is therefore an object of the present invention to provide a locking mechanism for a modular rifle that secures the selected caliber barrel extension/barrel assembly into the receiver with a sufficient compression force equal to that of conventional threads.

It is another object of the present invention to provide a locking mechanism for a modular rifle that has the ability to easily execute compression force and extension force to open and close the receiving barrel extension bore respectively.

It is yet another object of the present invention to provide a bolt stem and bolt face that provides greater accuracy than conventional bolt assemblies.

Still other objects and advantages will in part be obvious and will in part be apparent from the specification.

The above and other objects, which will be apparent to those skilled in the art, are achieved in the present invention which is directed to a rifle comprising a receiver, a barrel extension, and a projection. The barrel extension contains a cartridge chamber securable in an end of the receiver, and has a periphery with a depression. The projection is engageable with the receiver and the barrel extension depression. The projection is moveable between a loosened/unlocked position and a tightened/locked position. In the loosened/unlocked position, the projection engages the receiver and is out of engagement with the barrel extension depression, leaving the barrel extension free to slide in and out of the receiver. In the tightened/locked position, the projection engages the receiver and the barrel extension depression, thereby securing the barrel extension in the receiver. The barrel extension may have a cylindrical periphery.

The receiver and barrel extension have a longitudinal axis, and the projection may comprise a locking bar extending through the receiver in a direction normal to the longitudinal axis, and the depression in the periphery of the barrel extension is normal to the longitudinal axis and is sized to receive the bar. In a further embodiment, the projection comprises a pair of locking bars extending through a portion of the receiver and is engageable with a plurality of locking grooves in the periphery of the barrel extension. The locking grooves may further be geometrically conforming to the configuration of the locking bars.

In another embodiment the receiver is split at the end receiving the barrel extension and is moveable between spaced-apart and closer or closed positions. The spaced-apart position permits the barrel extension to slide in and out of the receiver, and the closer or closed position locks the barrel extension with the receiver. A pair of positioning bars are disposed on either side of the receiver split and are parallel to the longitudinal axis. The locking bars are disposed between the positioning bars and the barrel extension, such that when the positioning bars are urged toward each other the receiver split is narrowed and the positioning bars urge the locking bars toward and into the locking grooves to secure the barrel extension in the receiver.

In yet another embodiment the receiver has a cylindrical inner wall to receive the barrel extension and a pair of openings in the cylindrical inner wall adjacent the split for the locking bars. A screw extends through the receiver split below the cylindrical inner wall and connects the positioning bars. When the screw is loosened, the positioning bars are urged away from each other, the split is in the spaced-apart position, and the locking bars are out of the openings in the cylindrical inner wall of the receiver to permit the barrel extension to slide in and out of the receiver. When the screw is tightened, the positioning bars are urged toward each other, the split is narrowed, and the locking bars extend through the openings in the cylindrical inner wall of the receiver to permit the locking bars to move into the locking grooves to secure the barrel extension in the receiver. The rifle may further include a plurality of pairs of locking grooves spaced about the periphery of the barrel extension. The rifle may still further include a barrel, the barrel extension being threaded to receive an end of the barrel with a threaded connection. The rifle may also include a bolt slideable in the receiver, the bolt being engageable with a cartridge in the cartridge chamber during firing of the cartridge.

The present invention further provides a method of assembling a rifle. The method provides a receiver, a barrel extension, and a projection. The barrel extension contains a cartridge chamber securable in an end of the receiver, and has a depression in its periphery. The projection is engageable with the receiver and the barrel extension depression, and is moveable between a loosened or unlocked position wherein the projection engages the receiver and is out of engagement with the barrel extension depression, and a tightened or locked position wherein the projection engages the receiver and the barrel extension depression. The method includes moving the projection between a loosened or unlocked position, and sliding the barrel extension in or out of the receiver, and a tightened or locked position, and securing the barrel extension in the receiver.

In an embodiment, the method further includes the barrel extension having a cylindrical periphery. The receiver and barrel extension may have a longitudinal axis, the projection may comprise a locking bar extending through the receiver in a direction normal to the longitudinal axis, and the depression in the periphery of the barrel extension is normal to the longitudinal axis and is sized to receive the locking bar. The method may still further include the projection comprising a plurality of locking bars extending through a portion of the receiver, and engaging the projection with a plurality of locking grooves in the periphery of the barrel extension. The locking grooves may be geometrically conforming to the configuration of the locking bars.

In another embodiment, the method may further include the receiver being split at the end receiving the barrel extension. The receiver is moved to either of a spaced-apart position to permit the barrel extension to slide in and out of the receiver, or a closer or closed position to lock the barrel extension within the receiver. A pair of positioning bars are further provided, and are disposed on either side of the receiver split and parallel to the longitudinal axis. The locking bars are disposed between the positioning bars and the barrel extension. The positioning bars are urged toward each other to narrow the receiver split, while simultaneously urging the locking bars toward and into the locking grooves to secure the barrel extension in the receiver.

The method may still further include the receiver having a cylindrical inner wall to receive the barrel extension and a plurality of openings in the cylindrical inner wall adjacent the split for the locking bars. It may include a screw extending through the receiver split below the cylindrical inner wall, the screw connecting the positioning bars. Loosening the screw urges the positioning bars away from each other, places the split in the spaced-apart position, and the locking bars come out of the openings in the cylindrical inner wall of the receiver to permit the barrel extension to slide in and out of the receiver. Tightening the screw urges the positioning bars towards each other to narrow the split. The locking bars extend through the openings in the cylindrical inner wall of the receiver to permit the locking bars to move into the locking grooves to secure the barrel extension in the receiver. A plurality of pairs of locking grooves equally spaced about the periphery of the barrel extension may further be provided.

In a further embodiment, the method includes a barrel, wherein the barrel extension is threaded to receive an end of the barrel with a threaded connection. A bolt slideable in the receiver may also be included, the bolt being engageable with a cartridge in the cartridge chamber during firing of the cartridge.

The present invention also provides a rifle comprising a receiver, a barrel extension, and a bolt. The barrel extension contains a cartridge chamber securable in an end of the receiver, and has a periphery with a depression. The bolt comprises a bolt stem and a bolt face. The bolt stem is integrally formed with the bolt face as one piece, and the bolt face has at least one locking lug to support a chosen cartridge. The barrel extension and bolt are matched for a specific caliber of cartridge to be used in the rifle receiver.

In a further embodiment, the bolt face may have four locking lugs. These locking lugs may be located in quadrants of 0°, 90°, 180°, and 270°. The bolt face dimensions may conform to the diameter of the chosen cartridge.

The present invention further provides a method of changing a rifle caliber. The method provides a receiver, a barrel extension, and a bolt. The barrel extension contains a cartridge chamber securable in an end of the receiver, and has a depression in its periphery. The bolt comprises a bolt stem and a bolt face, the bolt stem being integrally formed with the bolt face as one piece, the bolt face having at least one locking lug to support a chosen cartridge. The method includes moving the barrel extension out of the receiver end, and removing the bolt from the receiver. A new barrel extension conforming to the desired caliber is inserted into the receiver end, and a new bolt conforming to the desired caliber is inserted into the receiver. The new barrel extension is secured in the receiver. The method may further include the new bolt and barrel extension comprising a set dedicated to the new caliber dimensions.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE EMBODIMENT(S)

In describing the preferred embodiment of the present invention, reference will be made herein to FIGS. 1-13 of the drawings in which like numerals refer to like features of the invention.

Figure 1:
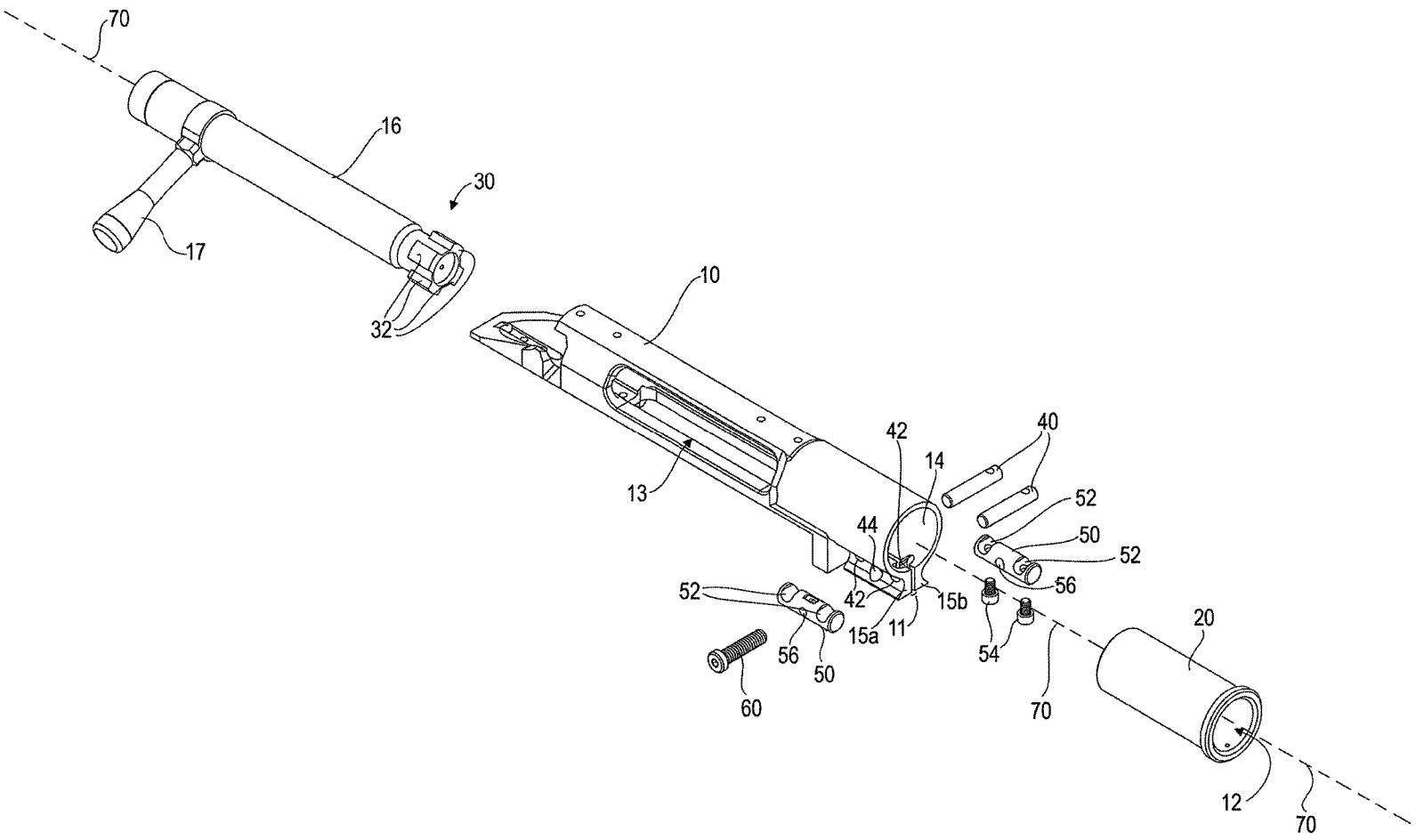
FIG. 1 is an exploded perspective view of the modular receiver assembly of the present invention.

Referring to FIG. 1, the rifle includes a receiver 10 and a barrel extension 20 containing a cartridge chamber 12 securable in an end of the receiver 10. The receiver 10 and barrel extension 20 are disposed along a longitudinal axis 70. The barrel extension 20 has a cylindrical periphery. The receiver has a forward opening with a cylindrical inner wall 14 to receive the barrel extension 20. The barrel extension may be secured to the end barrel 24 opposite the muzzle by a threaded connection 25 or may be integrally formed, e.g., of one piece, and comprises the breach end of the barrel.

Figure 2:
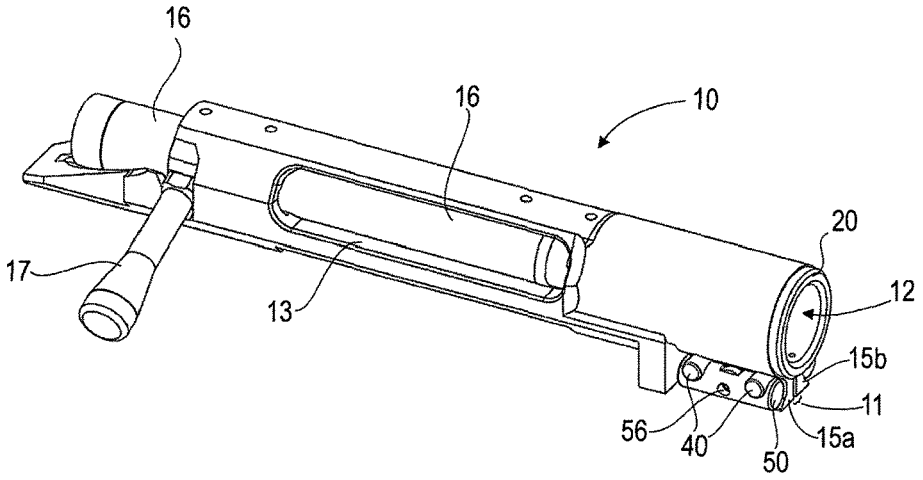
FIG. 2 is a perspective view of the modular receiver of FIG. 1.
Figure 3:
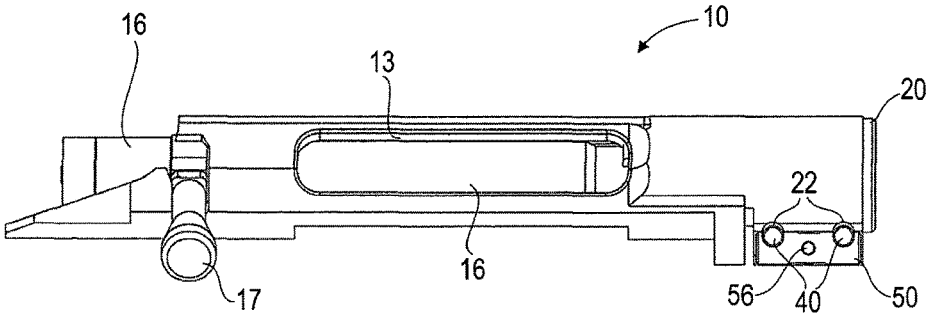
FIG. 3 is a side view of the modular receiver of FIG. 1.
Figure 4:
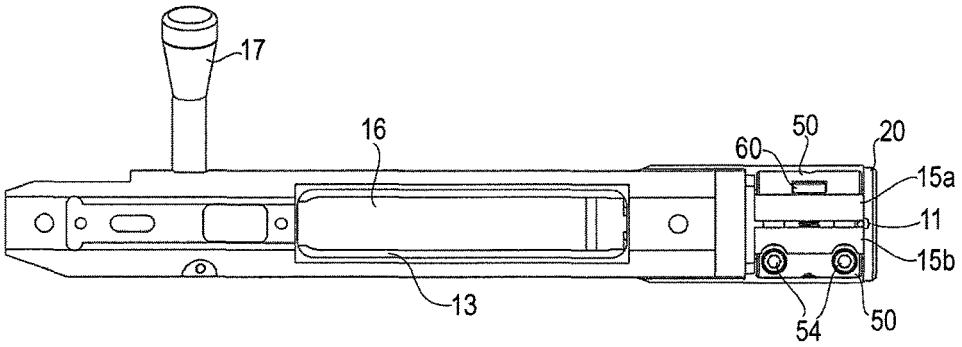
FIG. 4 is a bottom view of the modular receiver of FIG. 1.

As shown further in FIGS. 2-4, a bolt 16 is slideable longitudinally in the receiver 10. The bolt coupler handle 17 may be of solid, integral construction and removable from the bolt stem 16. The bolt 16 is engageable with a cartridge 18 (not shown) by movement of bolt handle 17 to move it from the receiver opening 13 into the cartridge chamber 12 of the barrel extension 20 for firing of the cartridge 18. As shown in FIG. 1, the bolt 16 may have a solid bolt face 30 with four locking lugs 32 in all quadrants having clock positions of 0°, 90°, 180°, and 270° in the feed and eject cycles. The bolt face 30 and bolt stem 16 are integral and of one piece. The handle 17 and bolt 16 assembly move the cartridge forward and are rotated 45° to lock the four locking lugs in clock positions of 45°, 135°, 225°, and 315° in the battery position before ignition and firing. This supports the selected cartridge 18 in alignment with the centerline of the rifle bore at peak ignition. Manufacturing of the bolt 16 may include a broach for a track connection to raceways in the receiver 10 body (not shown). The rifle receiver may include solid thrust lugs integral to the body of the receiver (not shown) against which the bolt locking lugs 32 bear. The weapon head space and battery lock up are between the bolt face lug system 30 and the barrel extension 20 that is in communication with the bolt face 30 at time of ignition but independent from the rifle receiver 10 in operation. This system allows good accuracy and multi-caliber modularity of specific families of cartridges 18 dependent on the bolt 16 stroke of the weapon for feeding and ejection (this is typically referred to in the firearms industry as short or long action). Receiver 10 at its forward end receives a barrel extension or barrel assembly 20 that when locked in battery culminates in a chambered cartridge that may meet a desired SAAMI (Sporting Arms and Ammunition Manufacturers' Institute) head space dimension and can be fired. The present invention can be employed in a multitude of action lengths and diameters to facilitate the selected cartridge 18. Because the bolt 16 and bolt face 30 are integral and of one piece, changing the caliber of cartridge 18 may require switching out a dedicated bolt 16 and barrel extension 20 set for each specific caliber. These dedicated bolt 16 and barrel extension 20 sets are sized to conform with the length and diameter of the new caliber cartridge 18 to be used. These sets (bolt 16, barrel extension 20, and cartridge 18) may be changed within the rifle assembly each time a different caliber is desired for use with the rifle.

The receiver 10 as shown may have a split 11 at the lower portion of the forward end receiving the barrel extension 20 between the planar inner facing surfaces of wall portions 15*a*, 15*b*. These wall portions 15*a*, 15*b* are moveable between a spaced-apart position to permit the barrel extension 20 to slide in and out of the receiver 10, and a narrower closer or closed position to lock the barrel extension 20 within the receiver 10 (FIGS. 7-10). The wall portions 15*a*, 15*b* may be moved with an assembly of locking bars 40, positioning bars 50 and trunnion screw 60, as described further below, to place the receiver 10 in spaced-apart and narrower closer or closed positions. The receiver 10 may be made from carbon fiber, or any suitable metal or alloy, such as, but not limited to, aluminum.

Figure 5:
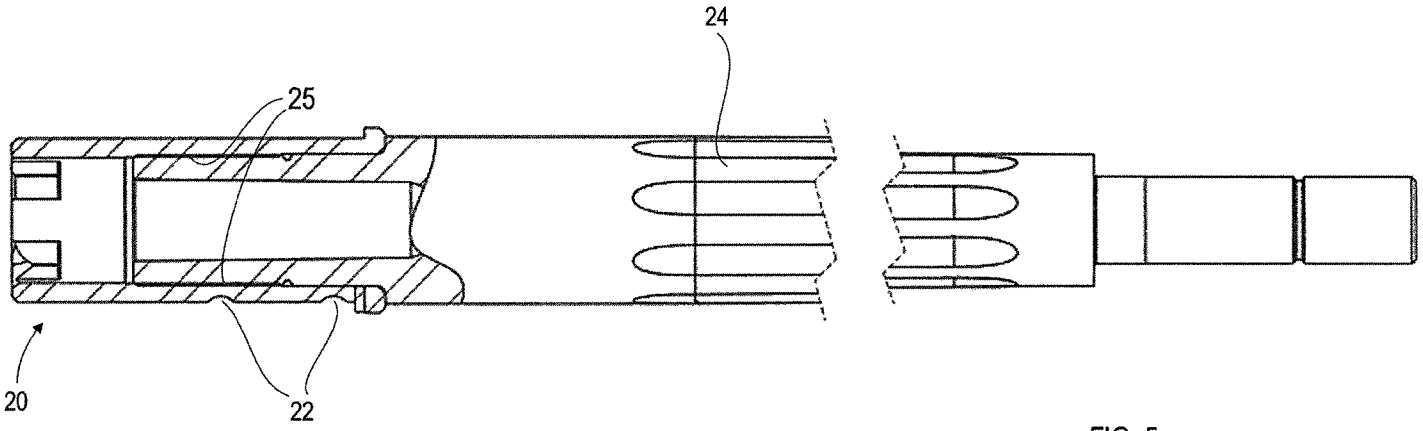
FIG. 5 is a partial cutaway cross-section and side view of the barrel and barrel extension of the present invention.
Figure 6:
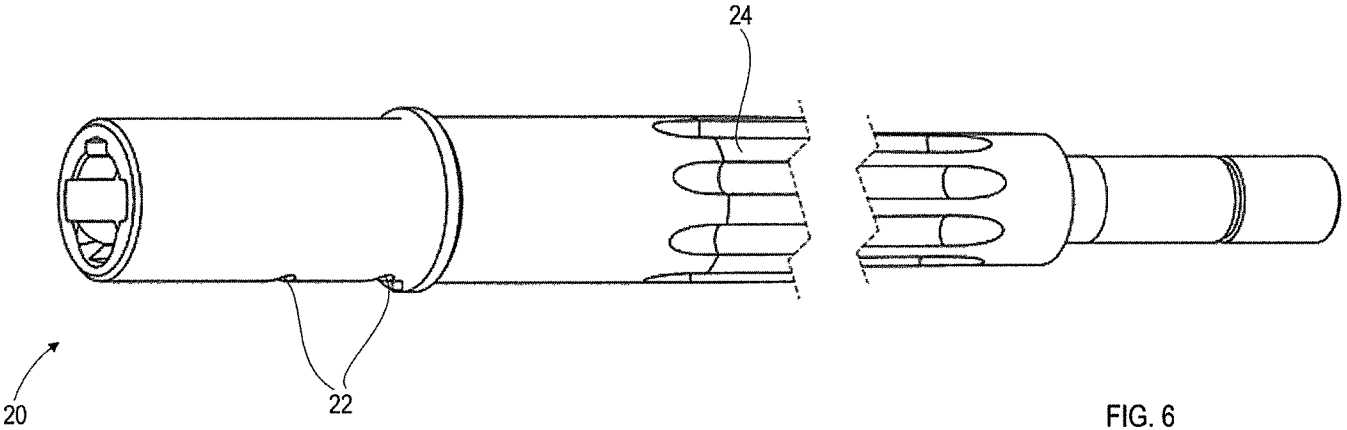
FIG. 6 is a perspective view of the barrel and barrel extension of the present invention.
Figure 12:
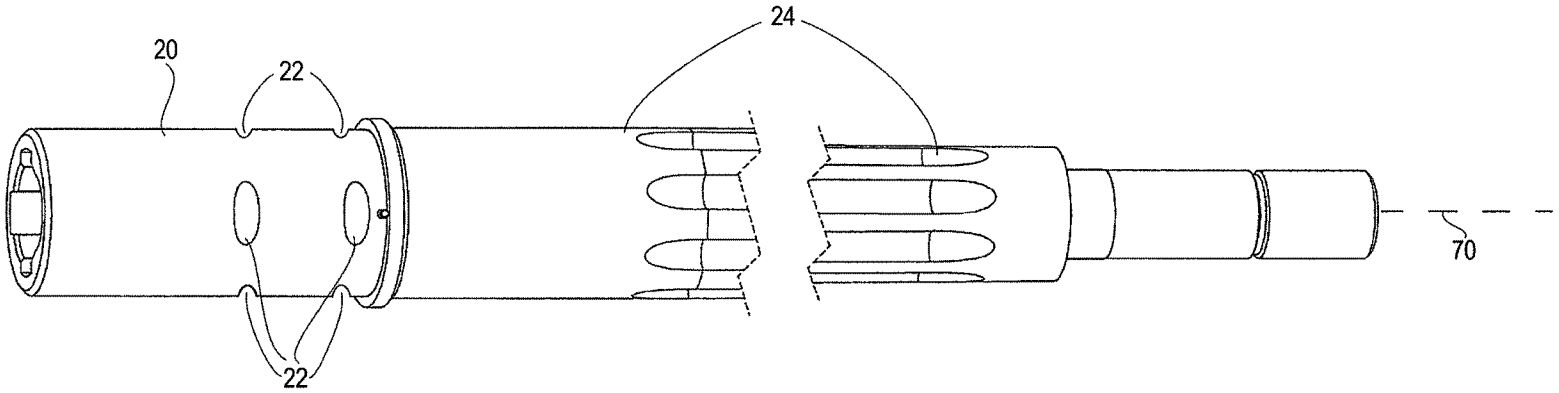
FIG. 12 is a perspective view of another embodiment of the barrel and barrel extension of FIG. 5.
Figure 13:
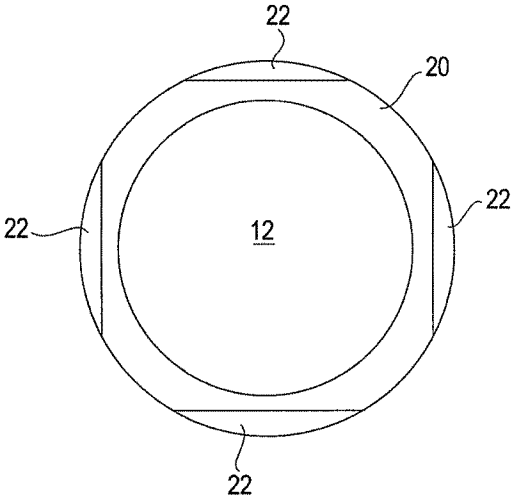
FIG. 13 is a cross-sectional view of an embodiment of the barrel extension of FIG. 12 taken along a cut normal to the longitudinal axis through the locking grooves.

The barrel extension 20 has at least one depression or locking groove 22 in the periphery (FIGS. 5-6). As shown in the embodiment of FIGS. 12 and 13, there may be a plurality of pairs of locking grooves 22 spaced about the periphery of the barrel extension 20, at 0°, 90°, 180° and 270°. Each depression 22 in the periphery of the barrel extension 20 is normal to the longitudinal axis 70 and sized to receive a locking bar 40, so the barrel may be secured in the receiver at different rotational positions.

A projection, shown as locking bar key dowel 40, is engageable with the receiver 10 and the barrel extension depression 22. The projection 40 may comprise at least one locking bar 40 (FIG. 11), and may have a plurality such as the pair of locking bars 40 shown extending through the receiver 10 in a direction normal to the longitudinal axis 70 (FIG. 1). To receive the locking bars 40, the lower wall portions 15*a*, 15*b* of receiver 10 as shown in FIG. 1 each have a pair of openings 42 in the cylindrical inner wall 14 aligned normal to the longitudinal axis 70 and through the split 11. Openings 42 are either elongated vertically as shown or otherwise have a larger vertical diameter than the locking bars to permit the locking bars to move upward and downward therein. The pair of locking bars 40 extend through the lower portion of the receiver 10 via the openings 42 and engage with the pair of locking grooves 22 in the periphery of the barrel extension 20. The grooves 22 correspond to the outer configuration of the locking bars 40, and in the embodiment shown each have cylindrical surfaces. The projection or locking bar 40 is moveable within the receiver 10 between a loosened or unlocked position (FIGS. 7 and 8), wherein the projection or upper surface of locking bar 40 is in a lowered position out of engagement with the barrel extension depression 22, leaving the barrel extension 20 free to slide in and out of the receiver 10, and a raised tightened or locked position (FIGS. 9 and 10) wherein the projection or locking bar 40 engages the receiver 10 and is seated in the barrel extension depression 22, thereby securing the barrel extension 20 in the receiver 10.

Figure 8:
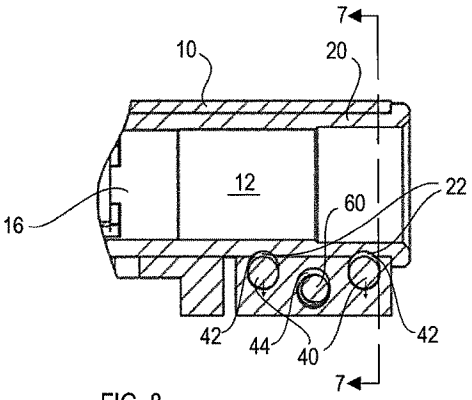
FIG. 8 is a cross-sectional view of the locking bar assembly in the open position along line 8-8 in FIG. 7.
Figure 7:
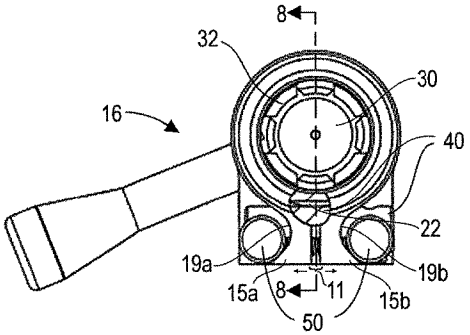
FIG. 7 is a cross-sectional view with a partial cutaway view of the receiver assembly with the locking bar in the open position along line 7-7 in FIG. 8.

To move the locking bars 40 in and out of the locking grooves 22, a pair of positioning bars 50 are disposed in cam tracks 19*a*, 19*b* on either side of lower wall portions 15*a*, 15*b* distal from the receiver split 11, parallel to the longitudinal axis 70. The locking bars 40 are disposed between the positioning bars 50 and the barrel extension 20, and are received in corresponding grooves 52 at each end of the upper surfaces of positioning bars 50. Fasteners 54 extending upward through openings in the grooves 52 may be employed to secure the locking bars 40 to the positioning bars 50. Cam tracks 19*a*, 19*b* are concave and have cylindrical ramped surfaces that are contacted by the positioning bars 50. A trunnion screw 60 extends through openings 44 in receiver lower portions 15*a*, 15*b* traversing split 11, below the cylindrical inner wall 14. Openings 44 are either elongated vertically as shown or otherwise have a larger vertical diameter than the screw to permit the screw to move upward and downward therein. The screw 60 connects the positioning bars 50, which straddle either side of the receiver split 11, through comparably threaded openings 56 in the positioning bars. As shown in FIGS. 7 and 8, when the screw 60 is loosened the positioning bars 50 are urged away from each other and slide down cam track 19*a*, 19*b* so that the lower wall portions 15*a*, 15*b* are spaced apart from each other across split 11. In this spaced-apart position, the screw 60 is in a lower position in opening 44 and the locking bars 40 are in a lower position in openings 42 in the wall portions 15*a*, 15*b*, out of engagement with locking groves 22, to permit the barrel extension 20 to slide in and out of the receiver 10.

Figure 10:
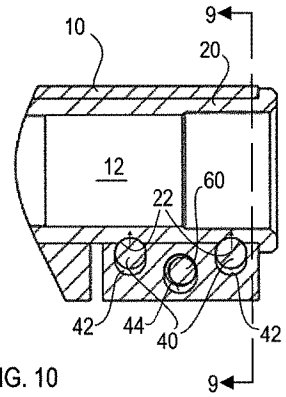
FIG. 10 is a cross-sectional view of the locking bar assembly in the closed position along line 10-10 in FIG. 9.
Figure 9:
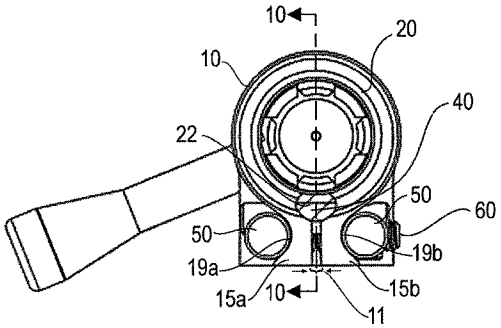
FIG. 9 is a cross-sectional view with a partial cutaway view of the receiver assembly with the locking bar in the closed position along line 9-9 in FIG. 10.
Figure 11:
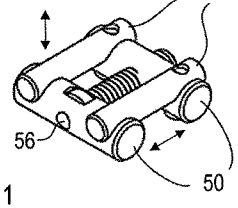
FIG. 11 is a perspective view of the locking and positioning bar assembly.

As shown in FIGS. 9 and 10, when the screw 60 is tightened, positioning bars 50 are urged toward each other and move up along cam tracks 19*a*, 19*b* until they are centered therein in their closest position, at which point the positioning bars cause the facing inner surfaces of wall portions 15*a*, 15*b* to move closer each other, and narrow or close split 11. As positioning bars 50 move upward along their respective cam surfaces they cause screw 60 to move upward in opening 44 and locking bars 40 to change elevation and move upward in openings 42 in wall portions 15*a*, 15*b* so that the upper surfaces of the locking bars move into and become seated in locking grooves 22 of barrel extension 20, which secures the barrel extension in the receiver 10 (FIGS. 9-10). After such tightening, the barrel extension 20 will be well secured in the receiver 10 so as to prevent rotational movement of the barrel extension within the receiver.

The present invention may be employed in the bolt action, multi caliber center fire rifle described herein, or in other types of rifles, to provide a highly modular and accurate precision rifle construction. The forced geometry of the assembly of the components keeps the action true to the rifle bore centerline.

The barrel extension clamping system as described herein forms a power up/power down locking system, which transmits motion via the trunnion screw in both locking (closed) and unlocking (open) directions. The rifle receiver includes the described receiver split to facilitate tightening and release of the barrel extension on its exit ramp portion. The locking bars may have a matching HT (Rockwell Hardness Testing) hardness to the barrel extension and may have a matching diameter to the locking grooves in the barrel extension.

The barrel extension may be threaded onto the gun barrel to a determined stop point to meet the chamber contact point for the head space to SAAMI specification. This dimension is regulated by a shoulder on the barrel and a shim system. Industry requirements exist for the measurements between the head space requirement and the spherical locking lug grooves on the outer diameter of the barrel extension that are in communication with the barrel lock mechanism housed in the receiver. The barrel extension interacts with a locking bar key dowel to hold the barrel extension in place. When set in place, the receiver end bore of the barrel extension is configured in such a way that it sets the rotation of the locking lug to the bolt handle assembly. The locking bar key dowel is received by the receiver split through corresponding grooves/openings bored through the split walls as described above. The barrel extension features control rotation and position of the barrel and chamber head space dimensional requirements.

The configuration of the present invention may include a bolt assembly made of one solid piece that is caliber-specific and controls the SAAMI head space dimension with the barrel extension when the assembly is in battery. In use, the multi-caliber changeover may be to change the barrel/barrel extension assembly with the bolt handle and magazine as a set for a specific caliber. Specifically, the multi-caliber changeover includes loosening the locking bar key dowel to open the receiver split, sliding the barrel extension out from the receiver end, and removing the bolt from the other end of the receiver. A new bolt is then inserted into the receiver, and a new barrel extension is inserted into the loosened receiver end. Both the new bolt and new barrel extension should conform to the changed caliber diameter and length. Finally, the locking bar key dowel is tightened to firmly secure the new barrel extension in the receiver end.

Accordingly, the present invention may include one or more of the following features and advantages:

The rifle receiver assembly may include a locking mechanism that secures the selected caliber barrel extension/barrel assembly into the receiver with a sufficient compression force equal to that of conventional threads. The locking mechanism also has the ability to execute a compression force and extension force to open and close the receiver's barrel extension bore, via a threaded trunnion screw. The rifle receiver may include an integral ramp feature to facilitate the elevation change of the locking pins via the trunnion screw between compression and extension operation.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A method of assembling a rifle comprising: providing a receiver having a longitudinal axis; providing a barrel extension containing a cartridge chamber securable in an end of the receiver along the longitudinal axis, the barrel extension having a depression in the periphery; providing a projection engageable with the receiver and the barrel extension depression, the projection moveable between a lowered unlocked position away from the longitudinal axis wherein the projection engages the receiver and is out of engagement with the barrel extension depression, and a raised locked position toward the longitudinal axis wherein the projection engages the receiver and the barrel extension depression; and moving the projection between a lowered unlocked position away from the longitudinal axis, and sliding the barrel extension in or out of the receiver, and a raised locked position toward the longitudinal axis, and securing the barrel extension in the receiver.

2. The method of claim 1 wherein the barrel extension has a cylindrical periphery.

3. The method of claim 2 wherein the projection comprises a locking bar extending through the receiver in a direction normal to the longitudinal axis, and the depression in the periphery of the barrel extension is normal to the longitudinal axis and sized to receive the locking bar.

4. The method of claim 3 further including the projection comprising a plurality of locking bars extending through a portion of the receiver, and engaging the projection with a plurality of locking grooves in the periphery of the barrel extension.

5. The method of claim 4 wherein the locking grooves are geometrically conforming to the configuration of the locking bars.

6. The method of claim 5 wherein the receiver is split at the end receiving the barrel extension, and further including:

moving the receiver to either of a spaced-apart position to permit the barrel extension to slide in and out of the receiver, or a closer or closed position to lock the barrel extension within the receiver; and further providing a pair of positioning bars disposed on either side of the receiver split and parallel to a longitudinal axis, the locking bars being disposed between the positioning bars and the barrel extension; and urging the positioning bars toward each other to narrow the receiver split, the positioning bars simultaneously urging the locking bars toward and into the locking grooves to secure the barrel extension in the receiver.

7. The method of claim 6 further including the receiver having a cylindrical inner wall to receive the barrel extension and a plurality of openings in the cylindrical inner wall adjacent the split for the locking bars, and further including a screw extending through the receiver split below the cylindrical inner wall, the screw connecting the positioning bars;

loosening the screw to urge the positioning bars away from each other, placing the split in the spaced-apart position, and the locking bars are out of the openings in the cylindrical inner wall of the receiver to permit the barrel extension to slide in and out of the receiver; and tightening the screw to urge the positioning bars toward each other, narrowing the split, and the locking bars extending through the openings in the cylindrical inner wall of the receiver to permit the locking bars to move into the locking grooves to secure the barrel extension in the receiver.

8. The method of claim 7 further including a plurality of pairs of locking grooves equally spaced about the periphery of the barrel extension.

9. The method of claim 1 further including a barrel, and wherein the barrel extension is threaded to receive an end of the barrel with a threaded connection.

10. The method of claim 1 further including a bolt slideable in the receiver, the bolt being engageable with a cartridge in the cartridge chamber during firing of the cartridge.

* * * * *